US006631676B2

(12) United States Patent
Weichmann et al.

(10) Patent No.: US 6,631,676 B2
(45) **Date of Patent: *Oct. 14, 2003**

(54) PROCESS AND APPARATUS FOR GRAVURE

(75) Inventors: Armin Weichmann, Kissing (DE); Arnim Franz-Burgholz, Augsburg (DE); Rainer Stamme, Augsburg (DE); Andreas Schiller, Mering (DE); Hans Fleischmann, Augsburg (DE)

(73) Assignee: MAN Roland Druckmaschinen AG, Offenbach am Main (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/999,954

(22) Filed: Dec. 5, 1997

(65) Prior Publication Data

US 2003/0010234 A1 Jan. 16, 2003

Related U.S. Application Data

(63) Continuation-in-part of application No. 08/422,492, filed on Apr. 12, 1995, now abandoned.

(30) Foreign Application Priority Data

Feb. 7, 1995 (DE) ..... 195 03 951

(51) Int. Cl.[7] ..... B41M 1/10

(52) U.S. Cl. ..... 101/170; 101/401.1; 101/153; 101/423

(58) Field of Search ..... 101/153–157, 101/167–170, 465–467, 401.1

(56) References Cited

U.S. PATENT DOCUMENTS

| | | | | |
|---|---|---|---|---|
| 3,455,239 A | | 7/1969 | Smith | |
| 3,589,289 A | | 6/1971 | Gosnell et al. | |
| 3,636,251 A | * | 1/1972 | Daly et al. | |
| 3,678,852 A | * | 7/1972 | Feinlab et al. | 101/401.1 |
| 4,181,077 A | * | 1/1980 | Dalton | 101/401.1 |
| 4,405,709 A | * | 9/1983 | Katano et al. | 430/307 |

(List continued on next page.)

FOREIGN PATENT DOCUMENTS

| | | |
|---|---|---|
| CA | 2096170 | * 11/1993 |
| DE | 14 22 499 | 10/1960 |

(List continued on next page.)

OTHER PUBLICATIONS

Article entitled "A Pre–Cavitated Rotogravure Plate And Method Of Preparing Same For Printing" taken from Technical Notes, A publication of RCA, pp. 1–2, written by Philip J. Donald; Apr. 10, 1969.

*Primary Examiner*—Eugene H. Eickholt
(74) *Attorney, Agent, or Firm*—Cohen, Pontani, Lieberman & Pavane

(57) ABSTRACT

A process and apparatus for gravure printing of an image using an erasable and reusable gravure form including a gravure blank form having a base screen which is designed for accommodating a maximum amount of ink to be transferred. The depressions of the base screen of the gravure blank form are uniformly filled with a liquefiable substance using an applicator device and material is then removed from the depressions in conformity with the intended image using thermal energy applied by an image-point transfer device. The printing form is then linked using an inking system and, finally, is regenerated after the printing process to produce a gravure blank form, wherein the depressions of the base screen are again filled in a uniform manner.

46 Claims, 7 Drawing Sheets

U.S. PATENT DOCUMENTS

| | | | | | |
|---|---|---|---|---|---|
| 4,729,310 | A | * | 3/1988 | Love, III | 101/157 |
| 5,072,671 | A | * | 12/1991 | Schneider et al. | 101/467 |
| 5,126,531 | A | * | 6/1992 | Majima et al. | 101/401.1 |
| 5,140,901 | A | * | 8/1992 | John | 101/350.6 |
| 5,278,027 | A | * | 1/1994 | Clarke et al. | 101/401.1 |
| 5,291,827 | A | * | 3/1994 | Liers et al. | 101/424 |
| 5,370,052 | A | * | 12/1994 | Reslow | 101/401.1 |
| 5,468,568 | A | * | 11/1995 | Kuhn et al. | 428/245 |
| 5,612,713 | A | * | 3/1997 | Bhuva et al. | 345/84 |

FOREIGN PATENT DOCUMENTS

| | | | | |
|---|---|---|---|---|
| DE | 20 54 833 | | 5/1972 | |
| DE | 25 31 514 | | 1/1976 | |
| DE | 27 48 062 | | 5/1978 | |
| DE | 37 39 829 | | 6/1988 | |
| DE | 38 37 941 | | 5/1990 | |
| EP | 0094142 | * | 11/1983 | 101/401.1 |
| EP | 310 798 | | 4/1989 | |
| FR | 20 75 204 | | 10/1971 | |
| FR | 23 70 306 | | 6/1978 | |
| GB | 1229243 | * | 4/1971 | |
| GB | 1410344 | * | 10/1975 | |
| GB | 1459048 | * | 12/1976 | 101/401.1 |
| GB | 1465364 | * | 2/1977 | 101/401.1 |
| GB | 1498811 | * | 1/1978 | |
| GB | 1544748 | * | 4/1979 | |
| GB | 2071574 | * | 9/1981 | 101/401.1 |
| GB | 2087796 | * | 6/1982 | 101/401.1 |

* cited by examiner

PROCESS AND APPARATUS FOR GRAVURE

CROSS-REFERENCE TO RELATED APPLICATIONS

This is a continued prosecution application of a continued-in-part application having Ser. No. 08/422,492 filed on Apr. 12, 1995 which is now abandoned and claims priority on German application DE 195 03 951.3 filed on Feb. 7, 1995 in German. The present application claims priority on application 08/422,492 and DE 195 03 951.3.

BACKGROUND OF THE INVENTION

The present invention is directed to a process and an apparatus for gravure using an erasable and reusable gravure form proceeding from a gravure blank form with a base screen which is designed at least for the maximum amount of ink to be transferred.

DESCRIPTION OF THE PRIOR ART

Gravure refers to a printing process using printing elements which are depressed relative to the surface of the form. After the printing form is completely inked, the printing ink is removed from the surface. The ink remains only in the depressed areas. Copper-coated steel cylinders, hollow cylinders mounted on tensioning cores or, in many cases, copper plates clamped on cylinders may be used as printing forms, for example.

Due to the type of inking and the wiping of the surface of the form with doctor blades, pure surface printing is not possible. The entire graphic must be resolved into lines, dots or screen elements. Due to their differing depth and magnitude, the individual printing elements take up varying amounts of printing ink. Consequently, the impression will have different ink values at different locations on the image.

Various working methods are currently used for producing a gravure form. For instance, in the variable-depth method, the etching principle consists in a gradual diffusion of concentrated ferric chloride solutions through a pigment-gelatin layer. The pigment reproduction on the copper printing form is formed of a hardened gelatin relief corresponding to the gradation of tones of the transparencies. The engraving process is characterized by line-scanning of the image and text by photocells and simultaneous engraving of the printing form by engraving heads. It should be noted in particular that depressions are made in the copper layer of the printing form by means of a high-energy electron beam which is directed on the blank form under vacuum and removes material in conformity with the intended image. The printing form which is engraved in this way can be provided with screens with varying depths and surfaces.

Depressions can also be made using a high-energy laser beam. In so doing, appropriate steps must be taken to ensure that the laser energy is coupled to the substrate, since copper is especially prone to reflect a laser beam when not subjected to special preconditioning.

Further, DE-OS 27 48 062 discloses a process for producing an engraved printing form in which a gravure blank form is first prepared by providing the smooth surface with depressions of equal depth and magnitude in a uniform manner and then covering the engraved surface with a light-sensitive substance so as to fill up all of the depressions. The blank form is then exposed photographically with the desired image so that the exposed areas are polymerized and the unexposed portions can be washed off, resulting in a differentiated image.

It can be asserted in general for all gravure processes that the depth of image locations on the printing form is greater than that of nonimage locations. In doctor-blade gravure, in particular, the screen grid forms webs of uniform height which define the image locations and form a support surface for the doctor blade. A special set of printing form cylinders (for each printing ink there must be one printing form cylinder with a corresponding number of printing sides) is required for every printing job. These cylinders are produced with the required cylinder circumference depending on the printing format. When setting up the gravure press or rotary printing machine, the appropriate printing form cylinders must be exchanged. A modern cylinder of this type, e.g., with a width of 200 cm, weighs approximately 800 kg. The mechanical cost for the processes described above is very high, since these processes can only be carried out outside the printing machine. In addition, each of these production processes involves steps such as electroplating or coating, exposure and development, which rules out the possibility of reusing the same printing form without extensive processing, in particular chemical processing. Further, after etching or engraving to form the image, that is, after removal of material, chroming is usually carried out to prolong service life.

If the printing form is to be stored for subsequent repeated applications, it is generally necessary to reserve space for the entire cylinder. For this reason, production of printing forms is very involved and therefore expensive, particularly when electroplating is required. Moreover, the resulting toxic sludge is objectionable in ecological respects.

On the other hand, DE 38 37 941 C2 which corresponds to U.S. Pat. No. 5,072,671 discloses a process for producing a gravure form in which the image can be produced directly in the printing machine and in which, moreover, the image can be removed from the gravure form in the printing machine and the gravure form can be prepared for a new image. Likewise in this case, a gravure blank form is produced with a base screen designed at least for the maximum amount of ink to be transferred. In the printing machine, an amount of thermoplastic substance in inverse proportion to the image information is then introduced into the depressed portions from a nozzle of the image-point transfer unit or by means of image-correlated ironing so as to reduce the effective volume of the depressions. In other words, in contrast to the other methods, the image is formed on the gravure blank form by image-forming application of material. After the printing job, the thermoplastic substance can then be liquified in the printing machine by means of a heat source and removed from the printing form cylinder by a wiping and/or blowing or suction device. This prior art teaches computer hardware and software which is useable in carrying out the present invention. As such, rather than repeat the subject matter, applicants incorporate the subject matter of U.S. Pat. No. 5,072,671, herein by reference.

However, the application of material to form images raises problems with respect to the positioning accuracy of the image. Material deposited on the webs cannot easily be introduced into the depressions completely. Yet, in order for all of the transferred material to contribute in a desired manner to the reduction in the effective volume of the depressions, this material must be introduced in its entirety.

SUMMARY OF THE INVENTION

Accordingly, the object of the present invention is to develop a process and an apparatus for gravure printing in which the gravure printing form can be produced inexpensively and also directly in the printing machine and in which the positioning of the image can be made more accurate.

Storage of gravure forms is eliminated since the cycle of characterizing process steps can be carried out repeatedly.

Another special advantage of the process according to invention and of the apparatus for carrying out this process consists in that wear on the gravure blank form is compensated for because the maximum image-forming depth in the applied substance on the gravure printing form is appreciably less than the original depth of the depressions of the prestructured blank form. That is, if the depth of the depressions is reduced due to wear on the webs, the maximum image-forming depth can nevertheless be achieved by a wide margin. For this reason, the webs of the blank form are also advantageously constructed so as to extend vertically to the surface of the gravure form as far as possible.

Advantageous constructions are contained in the dependent claims.

BRIEF DESCRIPTION OF THE DRAWINGS

Preferred embodiment examples and variants of the invention are explained in the following with reference to the highly schematic drawings.

DETAILED DESCRIPTION OF THE PREFERRED EMBODIMENTS

The image can be formed on the blank form 1 directly in the printing machine with the process and apparatus according to the invention. The gravure form on which an image has been formed can also be erased and prepared for reuse in a simple manner in the printing machine.

Figure 1:
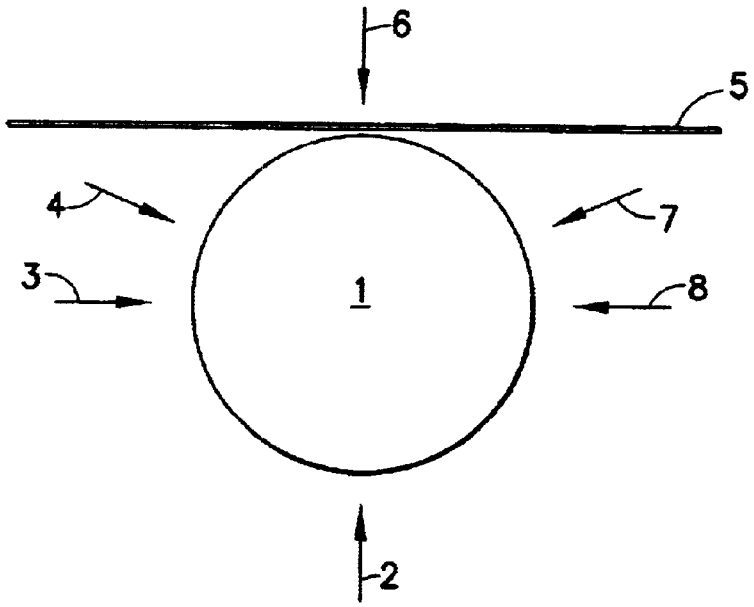
FIG. 1 shows the basic construction for carrying out the process steps according to the invention.

As is shown in FIG. 1, a prestructured gravure blank form 1 with a base screen designed for at least the maximum amount of ink to be transferred is filled in a first step at a point 2 during rotation of the form 1 with a liquefiable substance using an applicator device. Examples of the substance used for filling may be, e.g., a thermoplastic material or wax (hot melt), lacquer or a crosslinkable polymer melt or polymer solution. The crosslinkable polymer melt or polymer solution is also known as a reactive system and is characterized by an extremely high resistance to abrasion. The surface of the gravure form substantially smooth after filling. The filled in substance is then removed from the depressions at a point 4 during rotation of the form 1 so as to form an image by means of thermal energy applied by an image-point transfer device. The gravure form can now be inked at a point 4 during rotation of the form 1 by means of an inking system so that printing stock 5 may be printed at a point 6 by the gravure blank form.

After the printing process 6 on the printing stock 5, the surface of the gravure form 1 is regenerated in that the ink residues are cleaned off at a point 7 during rotation of the form 1, the liquefiable substance is preferably completely removed at a point 8 from the prestructured depressions, and the depressions are filled again in a uniform manner at a point 2. The liquefied substance can be removed from the prestructed depressions by means of a heat source and/or by a blowing or suction device.

Figure 2A:
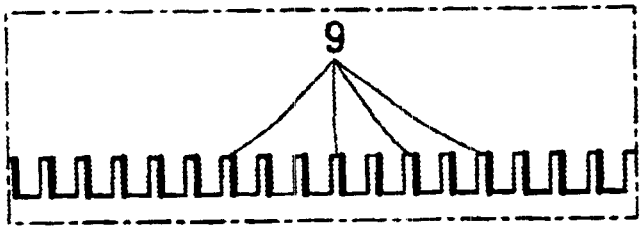
FIG. 2 shows a detailed view of the surface of a gravure blank form.
Figure 2:
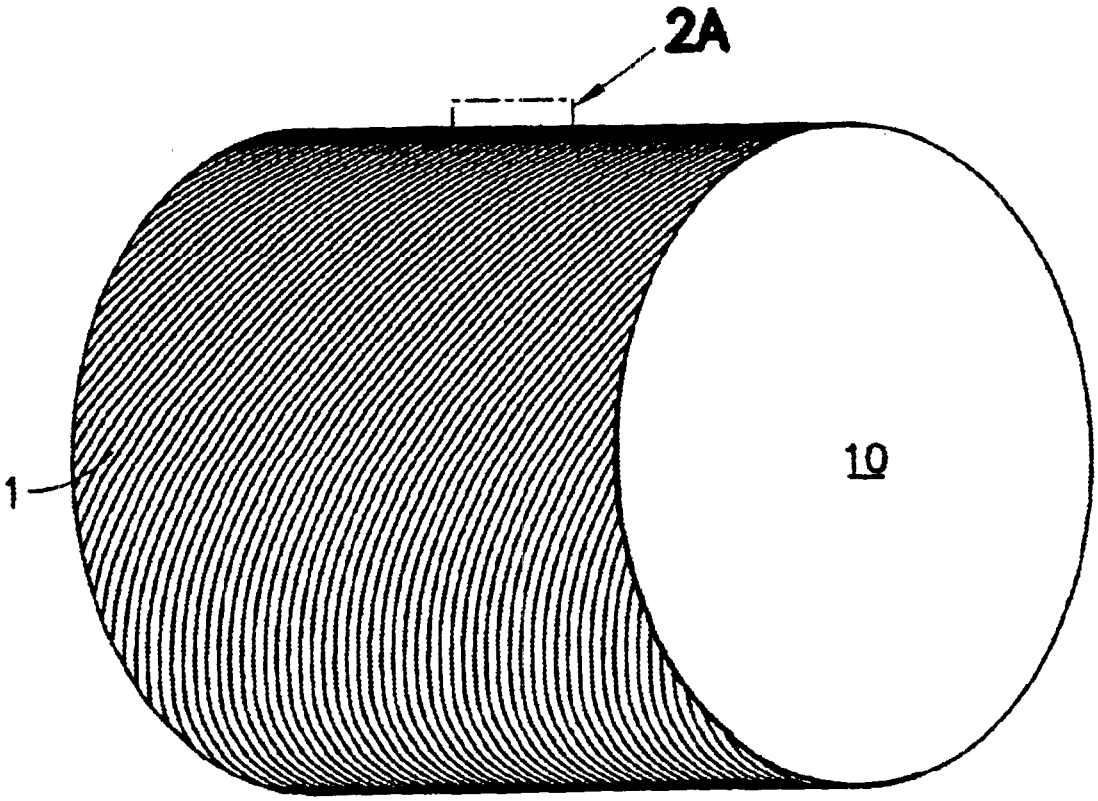

FIG. 2 shows a prestructured gravure blank form 1 on a cylinder 10 with webs 9 which extend helically around its cylindrical surface at a defined angle. The spacing between the webs 9 preferably corresponds to the spacing of currently used gravure screens. For an 80 line/cm screen, this spacing would be 125 $\mu$m. However, the spacing may also be substantially greater provided that the webs 9 can still guide the doctor blade dependably without noticeable flexing of the doctor blade and without resulting in excessive wear on the webs 9. The gravure blank form 1 is generally resistant to wear at least at the web surfaces, e.g., it is coated with chrome or titanium oxide or is produced from ceramics and is thus inherently very hard, and/or is provided with a defined roughness so that the doctor blade glides on a defined liquid film during printing.

Figure 3:
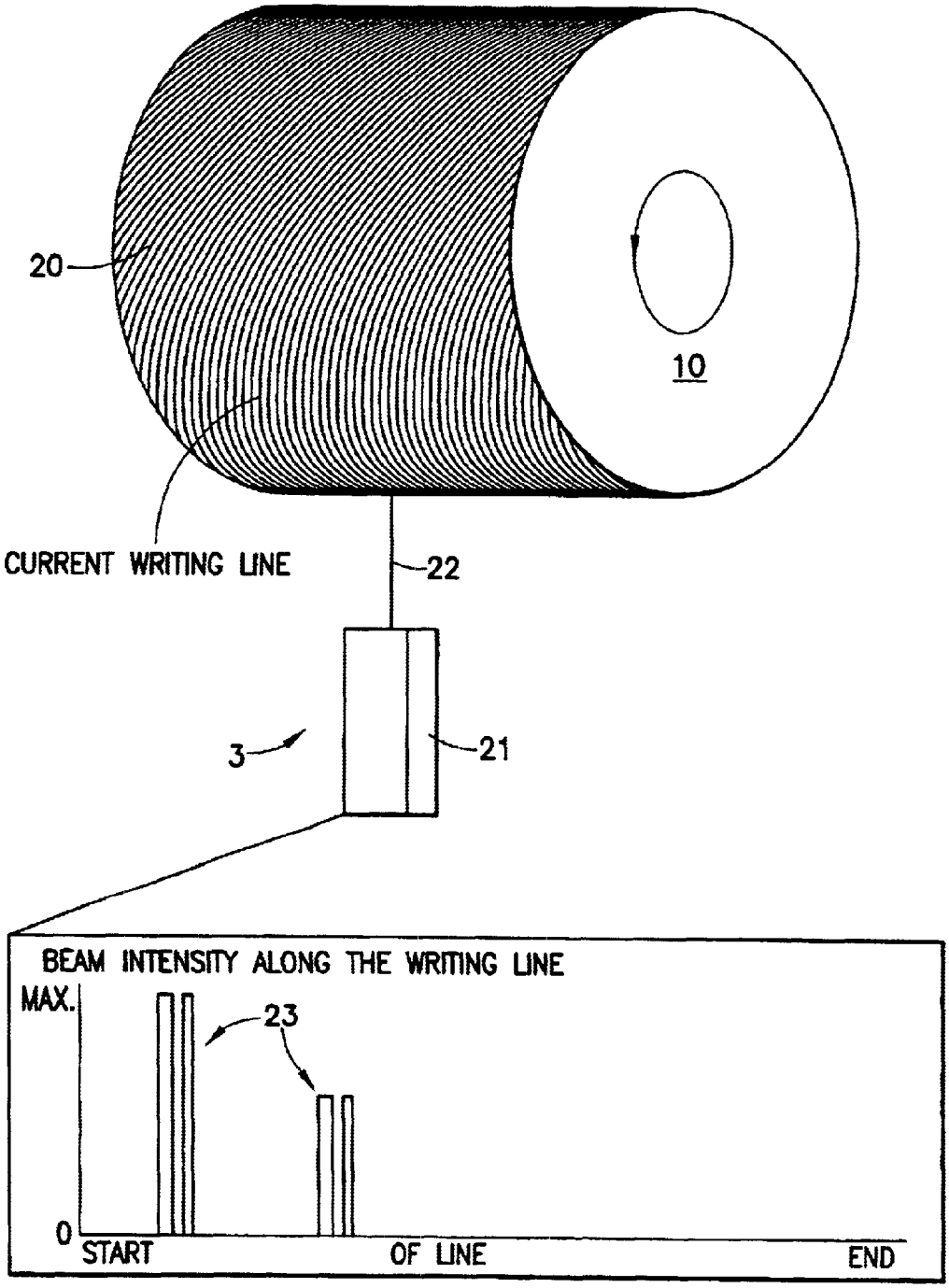
FIG. 3 shows the ablation of the liquefiable substance from the surface of a gravure form for the purpose of forming images depending on a given laser beam intensity per writing line.

After the depressions between the webs 9 of the gravure blank form 1 have been filled with the liquefied thermoplastic substance, the gravure form 20 can be provided with an image by burning off, as shown in FIG. 3, by the thermal energy of an image-point transfer device, in particular a laser 21 in a manner analogous to an external drum exposer. Nd; YAG or Nd: YLF lasers which are switchable between a plurality of intensity levers 23 via an acousto-optical modulator are preferably used. The laser beam 22 can be guided to the gravure blank form 1 and focused thereon via an optical fiber. It is preferably not to exceed a cell size of more than approximately 2/10 mm. That is, approximately after reaching this distance at most, the image-forming ablation produces a web which does not serve to guide the inking doctor, but rather to compel the cell to be emptied of ink during printing. Thus, it is possible in particular to address surfaces (pixels) which are smaller than an actual gravure cell so that a cell may be produced by a plurality of pixels.

Further, the image-forming ablation 3 can be assisted by setting the filled gravure blank form 1 in rapid rotation in such a way that some of the material to be removed is evaporated and some is thrown off.

In an advantageous variant, the gravure blank form 1 is not constructed as a solid cylinder, so that a low heating capacity is achieved. Thus, a thermally insulating layer, e.g., of fiberglass-reinforced carbon, is provided between a base layer and the surface layer which carries the base screen of the gravure blank form 1 and has a thickness of several tenths of a millimeter. The thermoplastic material used as liquefiable substance can also be a resin or a synthetic or natural wax.

Figure 4:
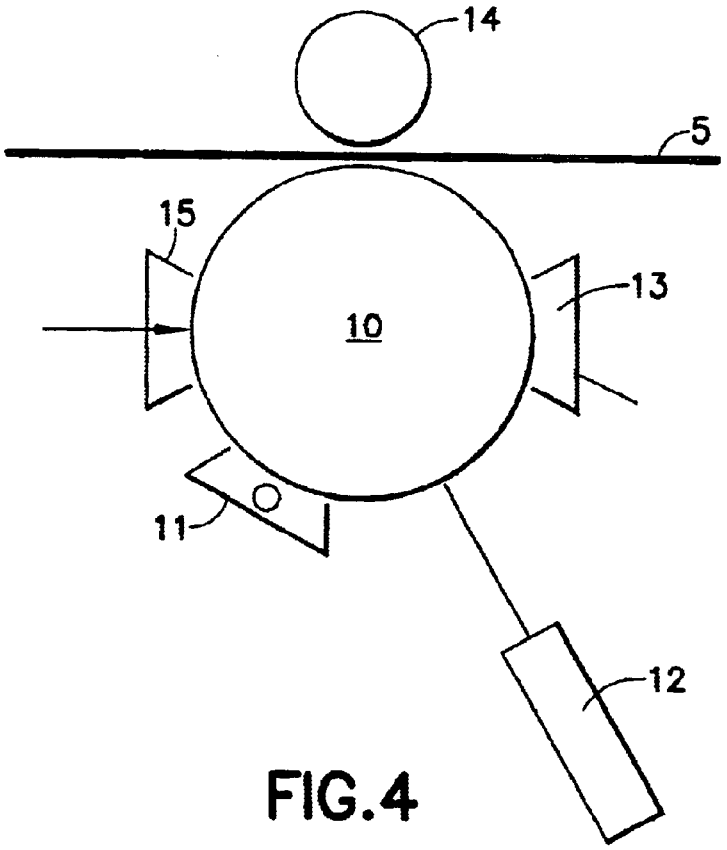
FIG. 4 shows an embodiment example of an apparatus according to the invention.

FIG. 4 shows a preferred embodiment example of an apparatus for implementing the process according to the invention.

Figure 5:
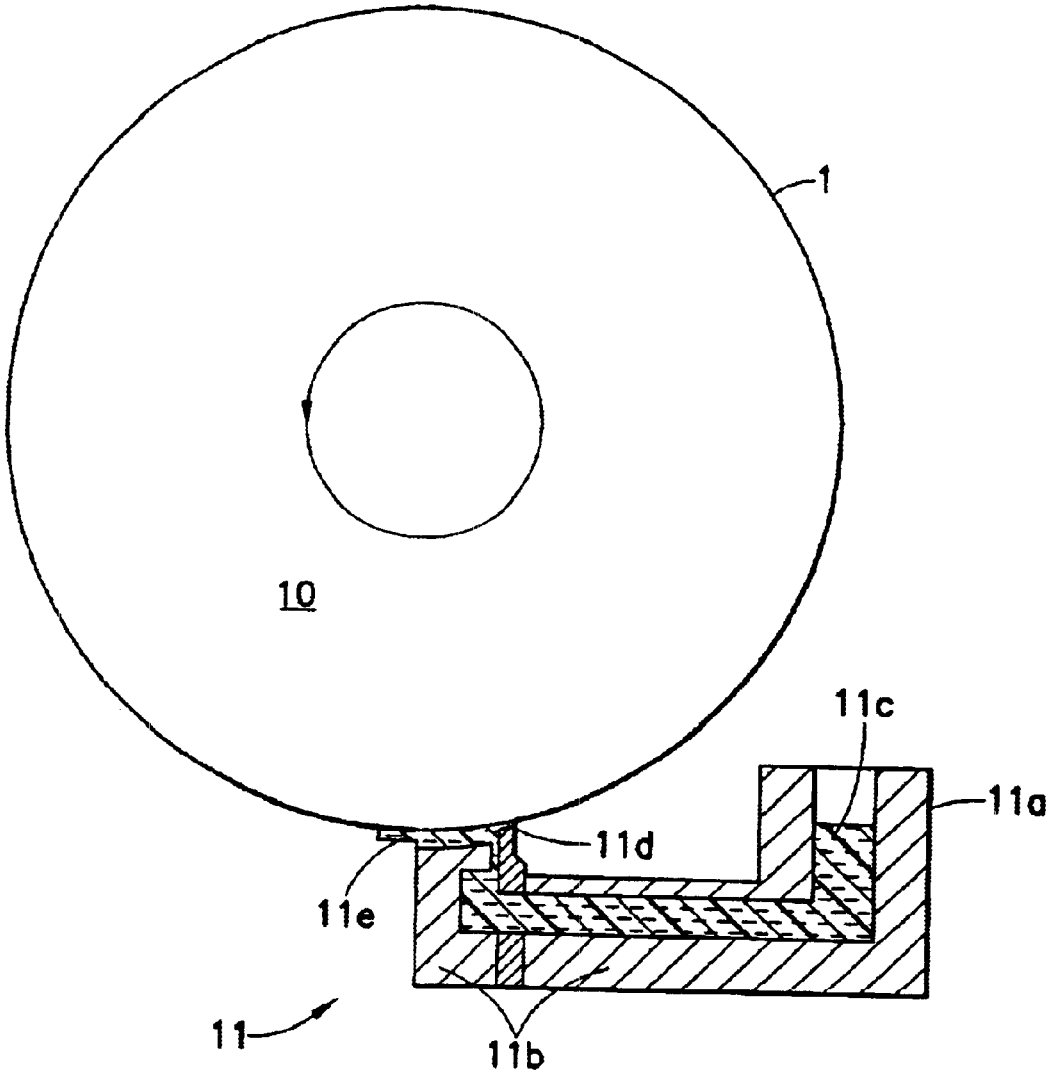
FIG. 5 shows an applicator device.

A device 11 for applying a liquefiable substance directly to a gravure form cylinder 10 supporting the gravure blank form 1 is arranged inside the gravure press so as to be adjustable. A preferred construction of this device 11 is illustrated in FIG. 5. This device 11 comprises a box 11*a* which opens toward the surface of the gravure blank form 1 and contains a heating cartridge 11*b*. The device 11 is heated and contains the molten thermoplastic 11*c* which can be filled and refilled in granulated form. The melt 11*c* is introduced on the surface of the gravure blank form 1 by gravitational force and capillary action and penetrates into the depressions of the base screen. Compressed air or hydraulic pressure generated by means of a pump can also be used instead of gravitational force. Due to the narrow gap between the gravure blank form 1 and the applicator device 11, a capillary and hydrodynamic force introduces precisely the amount of substance required for filling.

Two formed strips 11*d*, 11*e* (FIG. 5) are provided for the device 11. One of them (11*e*) is provided in front of the narrow gap between the gravure form 1 and applicator device ii while the other (11*d*) is arranged after this gap as viewed in the rotating direction of the gravure form cylinder 10. The formed strip 11*d* subsequent to the gap has a form corresponding to the form of the cylinder 10 and is positioned at a very small distance therefrom (some hundredths of a millimeter) by means of precise guidance or by supporting cheeks and is designed so as to be heatable in order to adjust the viscosity of the filling material so as to promote the effect of the hydrodynamic forces and ensure a complete filling of the depressions of the base screen. Further, the rear edge of this strip 11*d* is sharpened in order to ensure a clean tearing of the filling material from the gap. The front formed strip 11*e* is held towards the cylinder 10 at a distance greater than the distance between the back formed strip 11*d* and the cylinder 10 (several hundredths of a millimeter to several tenths of a millimeter) so that the gap, which accordingly widens, is filled with material but the hydrodynamic forces have an appreciably reduced effect. The actual filling occurring in the region of the formed strip 11*d* is accordingly prepared, in particular by means of heating and pre-filling the thermally insulated surface of the printing blank form.

An excess amount of the liquefiable substance 11*c* can also be applied to the gravure blank form 1 in the heated state. After cooling, the surplus is then removed, i.e., wiped and/or polished, from the gravure blank form 1 by means of an adjustable position of the doctor blade 12. The doctor blade 12 can change for this purpose. After the thermoplastic material has cooled, the filled surface of the gravure blank form 1 is preferably polished again in order to adjust the roughness of the surface in a defined manner.

After ablation 3 of the filled gravure blank form 1 in accordance with the intended image, the gravure form can be inked by means of an inking system 13. A chamber doctor is preferably used for this purpose since it requires less space at the circumference of the cylinder than a conventional inking system and can simply be withdrawn from the gravure cylinder 10 during the other process steps. Of course, the applicator devices 11, doctor blade 12 and image-point transfer unit (e.g., the laser 21) and other devices can be removed from the gravure cylinder 10 during the inking so as to protect them from ink and ink mist.

As will be seen from FIG. 4, printing stock 5 can now be printed against an impression cylinder 14 by gravure, but preferably by indirect gravure. In indirect gravure, the paper is not printed upon directly by the printing form cylinder, but rather a roller coated with a smooth rubber surface is located between the printing form cylinder and the paper. This roller serves as an intermediate substrate and thus decouples the printing form cylinder from the printing stock. In conventional direct gravure, two hard materials roll off one another in the printing gap between the printing form cylinder and printing stock. The printing stock additionally provides an abrasive action. In order to counter this, hard materials are required for the printing form. In indirect gravure, two printing gaps are used instead of one, wherein a hard material rolls off a soft material in each case. In addition, the printing form cylinder no longer comes into direct contact with the abrasive paper medium. This permits substantially softer materials to be used without decreasing the service life of the materials. The doctor blade, the other part which is subject to wear at the printing form cylinder, is guided by the webs formed of hard material and thus also does not contact the softer filling material suitable for thermal ablation. As a result of this step, the service life of a gravure form produced according to the invention is substantially improved.

After the required printing process, ink residues are cleaned off the gravure form by means of a regenerating device 15, preferably in the form of an ultrasonic cleaning installation which is likewise constructed as an adjustable system similar to a chamber doctor, and the liquefiable substance is removed from the depressions of the base screen of the printing blank form 1 so that the cycle (filling 2, image-forming ablation 3, inking 4, printing 6, regeneration 7, 8) can start from the beginning.

The ultrasonic cleaning installation can be operated on at least two different levels or stages. A first level, or stage having low sonic energy and/or with a liquid serving only to loosen the ink, serves to remove the remaining ink. The other levels or stages each have correspondingly higher sonic pressures and/or other cleaning agents, serve for partial or complete removal of the filling material.

Another important advantage of the invention consists in the noticeable improvement in quality compared to conventional gravure, particularly with respect to text reproduction. This is achieved in that the writing resolution for producing images lies well below the spacing between two webs, e.g., 500 lines per cm. Accordingly, text can be screened at this high resolution and character edges can be achieved which are substantially sharper than in conventional gravure. In general, approximately 400 lines per cm are specified as the lower limit for good text reproduction. Conventional gravure form production has a resolution of 120 lines per cm maximum and must therefore simulate sharp edges with more or less small dots interrupted by blank spaces. This is why gravure text always has a so-called sawtooth effect.

In order to achieve the same quantity of gray steps in the image as the gravure which varies every dot in up to 200 depth steps, a binary exposer, i.e., one working in variable-surface operation, must be able to write at least 1000 lines per cm. Although this binary writing mode is also suitable in principle, the present invention preferably uses a combination of variable-surface and conventional, i.e., variable-depth, gravure screening known as a hybrid screen. This screen is written, for example, with 500 lines per cm. However, every dot can be graduated in a plurality of depths. For instance, five different depths (0%, 25%, 50%, 75% and 100%) at a writing resolution of 500 lines per cm achieves the same halftone quality as a writing resolution of 1000 lines per cm and only two depths (0% and 100%) or a writing resolution of 100 lines per cm and 101 different depths. If 10 different depths are used, for example, this corresponds to the information content of 250 gray steps at 100 lines per cm. The present density information which is typically given at a resolution of 256 steps is converted into the hybrid screening model, which has appreciably fewer than 256 steps per writing point, typically roughly 10, by the known preliminary printing step techniques of "error diffusion", dithering or stochastic screening. All of these methods are normally used only for binary screening, but can be expanded to more than two thresholds. In particular, an image pixel can be ablated in a number of steps of different depth ranging from 2 to 256.

In order to reduce the necessary maximum depth of the depressions, between 20 μm and 40 μm in conventional gravure, highly pigmented, particularly water-based, inks are used. The advantages of this reduction reside in the lower image-forming output required for achieving a given ink density and in the reduced addition of water in the paper, which considerably accelerates drying.

Wear on the gravure blank form is compensated for in that the maximum image-forming depth is appreciably less than the depth of the depressions in the prestructured gravure blank form. If the depth of the depressions is reduced as a result of wear of the webs, the maximum image-forming depth can nevertheless be easily attained. For this purpose, the webs are to be structured with vertical walls as far as possible. Narrowing of the depressions as a result of increasing web thickness can be compensated for during exposure by process techniques by determining the volume characteristic at periodic intervals and compensating accordingly.

Different advantageous variants of the steps according to the invention are possible. For example, a blank form with uniformly arranged depressions, as used in conventional form production, can be used instead of the gravure blank form with helically arranged webs as described above. The magnitude of the depressions can differ from the fine screens commonly used today which have cell sizes starting from 80 μm to very large depressions with respect to area, e.g., cell sizes of 1 mm or more. The form can have stochastically distributed depressions instead of uniformly distributed depressions in order to prevent the risk of moire formation, particularly when printing with multiple inks. The random distribution can be produced, e.g., by exposing the gelatins used for conventional etching with speckles produced from coherent laser light rather than with a cross-line screen. In this case, a wax combined with 5% carbon black is preferably used as filling material.

The regeneration of the gravure form can also be carried out with high-pressure water jets. For example, an arrangement such as that already disclosed by EP 9 310 798 is used for this purpose. An arrangement of this kind is formed of a double-walled chamber which is open toward the gravure form and is closed off relative to the surroundings by seals guided along the form. The inner cell contains nozzles through which water is sprayed at high pressure on the surface of the gravure form. Suction is applied to the covered outer chamber region so that the liquid is removed in particular from the region which has already been cleaned and the gravure form is clean and dry after processing.

The high-pressure cleaning arrangement can operate in at least two different modes. One mode, using low liquid pressure and/or liquid temperature serves substantially to remove remaining ink, while the additional modes each use a correspondingly higher liquid pressure and/or liquid temperature serve for partial or complete removal of the filling material.

Different pressure and temperature parameters are applied depending on whether a first cleaning or intermediate cleaning is to be carried out. If only adhering dirt and ink residues are to be cleaned off, a relatively low temperature in the range below 50° C. and low pressure of several bar will be used. If a first cleaning is to be carried out, temperatures in the range of the softening or melting temperature and pressures in the range of 30 bar are to be used. Agents such as surfactants as well as particles can be added to the cleaning water to improve effectiveness.

The depressions in the gravure blank form can also be filled by an applicator roller which draws from a material reservoir and preferably rotates in the opposite direction to the rotating direction of the gravure form cylinder. After application, the filling material is wiped off by a doctor blade. The angle of the doctor blade is preferably distinctly negative, i.e., the doctor blade cuts like a knife. In particular, the doctor blade can also be heated. The gravure form can also be heated inductively before and during filling and during wiping. Regeneration, filling and wiping can preferably be effected during one and the same cylinder revolution.

If thermoplastic materials are used, heat may be applied, for instance, via an infrared radiation source or heated air and materials which suck the thermoplastic material out of the depressions by capillary action or, e.g., a highly absorbent paper or a blowing or suction device can be used.

It is also possible to clean only adhering dirt and ink from the gravure form without removing filling material and to refill the portions of the form removed during the preceding image formation step. Complete erasure can then be carried out after a given number of cycles to produce a blank form.

Further, photopolymers which are hardened by laser and developed by means of water can also be used as filling materials. Lacquer can also be applied successively in multiple layers with intermediate drying in order to fill the depressions completely, or the reactive systems already mentioned above can also be used. The filling materials are sensitized to the type of radiation used, e.g., by adding carbon black.

The surface of the gravure form can be smoothed after filling by polishing or wiping with a heated doctor blade. This can also be effected by means of a hot-air jet or by the laser beam used for image-forming ablation at low beam intensity. This can be carried out in the course of normal image formation by irradiating the nonimage areas with a defined but considerably lower output in relation to the image-forming ablation so as to result only in melting.

Of course, instead of a laser beam, in particular a high-energy laser beam, a plurality of parallel beams can also be used. Any thermal laser source such as semiconductor lasers, in particular a laser arrangement formed by a plurality of semiconductor lasers, Nd:YAG lasers, $CO_2$ lasers, can be used sources of radiation waves. A laser radiating in the ultraviolet or blue range, e.g., an argon laser, must be used for photopolymer filling. Further, spark erosion or a water jet can be used instead of a light source for material removal, e.g., if high resolution is not required.

Figure 6:
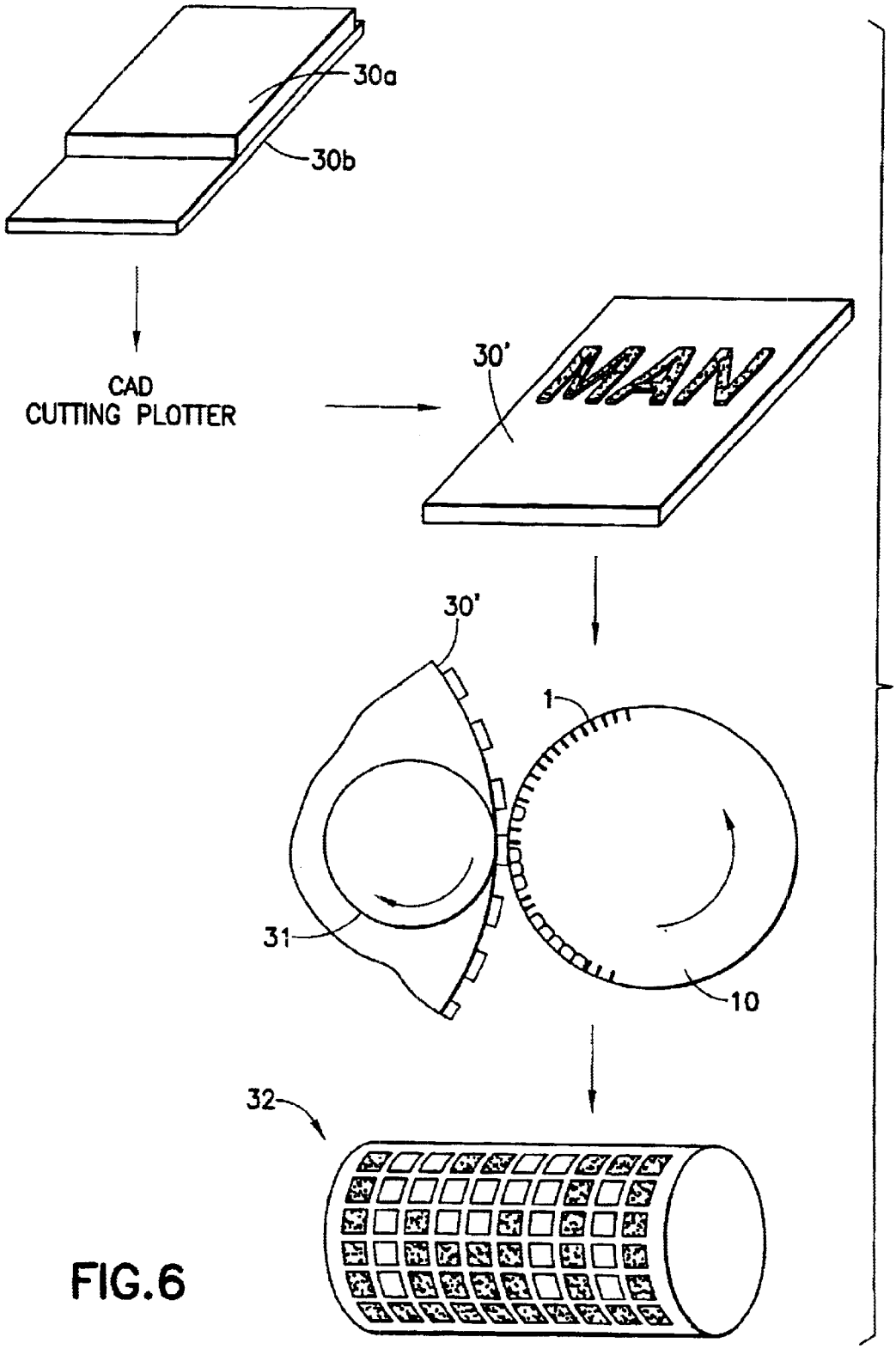
FIG. 6 shows an image-point transfer device for image-forming ablation by suction.

An absorbent paper (e.g., blotting paper), which is cut according to the intended image, can be used for producing an image forming ablation. This procedure is explained more fully with reference to FIG. 6. A multilayer foil 30' is used as a base. An absorbent material **30*a* (e.g., blotting paper) is applied to a nonabsorbent substrate 30*b*. The unneeded areas are cut out and removed by means of a CAD cutting plotter. This is conventional in foil cutting techniques. The absorbent material 30*a* and non-absorbent substrate 30*b* thus form the multilayer foil 30. The foil 30' is then applied to the gravure form cylinder 10 which has already been provided with the filled blank form. The foil 30' is ironed over the gravure form cylinder using a heated roller 31. The filling material is then sucked out of the absorbent material 30*a* by capillary forces at those locations contacted by the absorbent foil material, whereas this does not occur at the locations in contact with the nonabsorbent substrate. The image can be differentiated to produce an image-forming ablation 32** in this way. However, it is only possible to differentiate substantially between full tones and paper white.

Figure 7:
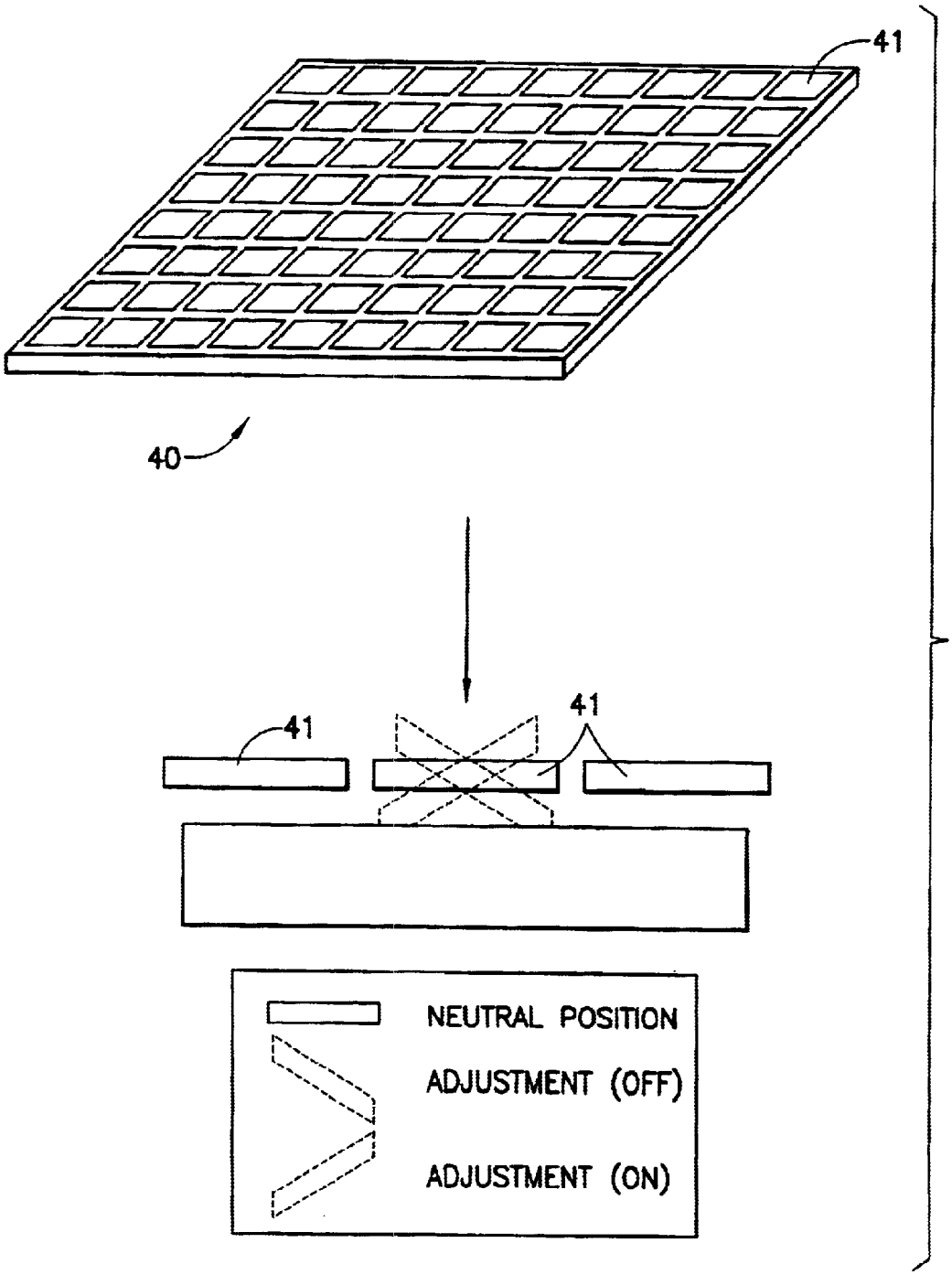
FIG. 7 shows the construction of a micromirror array for an image-point transfer device for image-forming ablation.

Image-forming ablation can also be produced using a micromirror array 40. The construction of such an array 40 is shown in FIG. 7. A typical array 40 of this kind is formed of individually electrically tiltable micromirrors 41 with a typical area of 20 $\mu$m×20 $\mu$m arranged in a matrix of 1000×2000 elements. These micromirrors 41 may be in a rest position, an off position or an on position as shown in FIG. 7.

Figure 8:
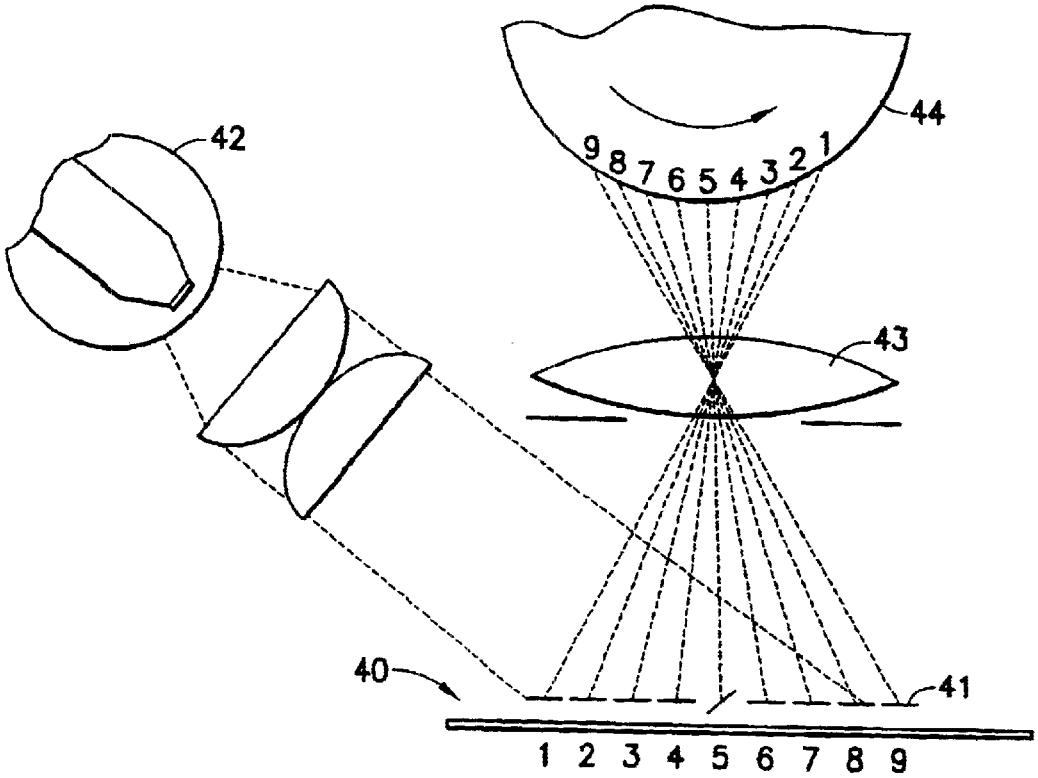
FIGS. 8 and 9 show an arrangement for image-forming ablation according to FIG. 7.
Figure 9:
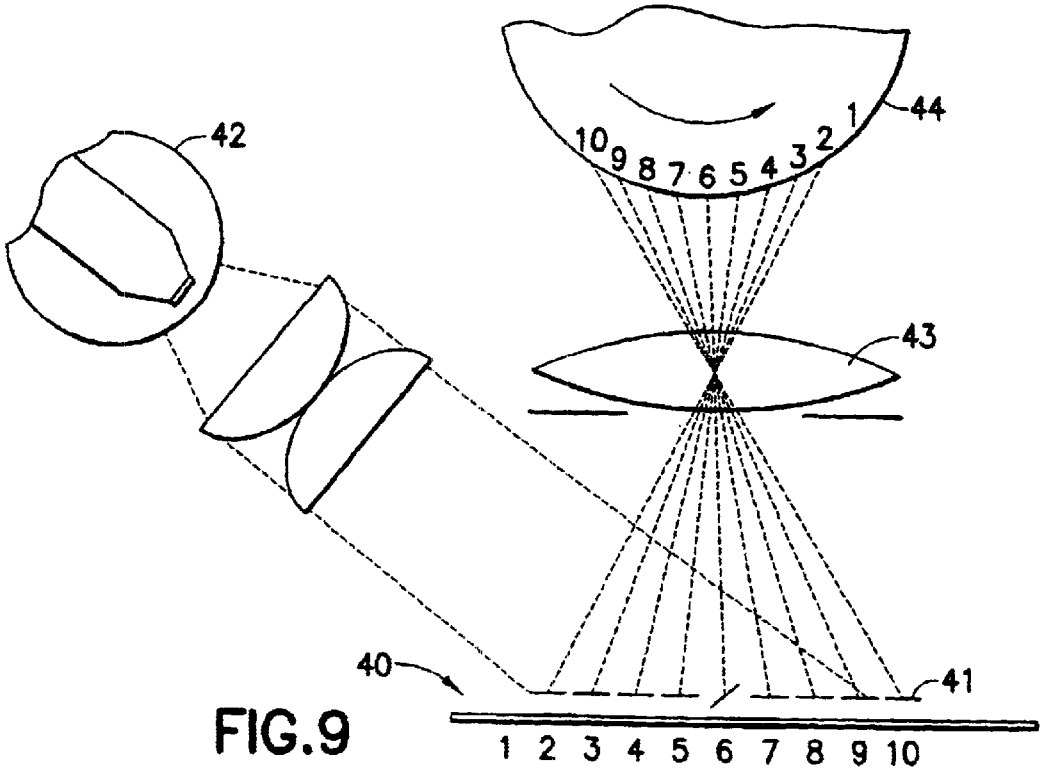

FIGS. 8 and 9 show an example of an arrangement of an array 40 of this type for an image-point transfer unit for image-forming ablation. The mirror array 40 is uniformly illuminated by means of a high-energy arc lamp 42 and is imaged on the surface 44 of the printing form by an optical system 43 at an imaging scale of approximately 1 in such a way that the edge of the array 40 with the 2000 elements is disposed perpendicular to the rotating direction of the form cylinder, i.e. parallel to the axis of rotational. This edge defines the image lines. One pixel is defined as the field on which a mirror is imaged geometrically and calculations are carried out relative to the surface of a mirror to determine the half of the nonimaging edge regions adjacent to the mirror until the next respective adjoining mirror. A mirror reflects the energy radiated upon it onto the form and in this pixel at a spatial angle determined by the apertures of the imaging optical system. The printing form cylinder rotates and 2000 image columns are written simultaneously. A mirror addresses a pixel when more than 50% of its surface is imaged thereon. Accordingly, a line of pixels which is stationary with respect to the cylinder travels through the lines of the mirror array 40, i.e., an increasing number of lines of the mirror array are gradually illuminated (FIG. 9).

Suitable electronics (essentially a multielement shift register) provide for an allocation of image data synchronized to this travelling. The image data are filled into the first line. The image data travel downward line by line synchronously with the rotation of the cylinder, and the next respective line of image data is taken over in the first line. During this traveling, a mirror can always be switched on or off. A determined pixel can thus obtain 0 to 1000 units of energy. For instance, in order to act upon a pixel with 4/10 of the maximum energy dose, 400 mirrors are switched on and 600 mirrors are switched off during this wandering, while they address the pixel. Thus, the addressing of the mirror elements 41 is changed synchronously with the rotation of the gravure form surface 44 in a manner analogous to a shift register so that the allocation of an image pixel to the printing form surface 44 with its corresponding exposure data value is maintained on the form surface 44 along the entire imaging surface of the mirror array 40. The arrangement of the on/off mirror is optional, but may possibly be predetermined in conformity to process techniques.

In principle, surfaces (image pixels) which are smaller than the surface elements of the base screen of the gravure blank form 1 can be addressed by the image-forming ablation 3 as shown in FIG. 1. In particular, the image-forming ablation 3 can even be carried out substantially independently from the base screen. However, the image-forming ablation 3 can also be adapted to the base screen, i.e., can have a determined geometric ratio thereto. Ideally, the image-forming ablation forms the depressions of the base screen as needed according to process techniques.

After one revolution of the cylinder, the print head is displaced by 1000 pixels and the cycle starts from the beginning. Alternatively, a continuous forward feed of the print head which displaces the head by 1000 pixels in one revolution of the printing form cylinder can also be carried out.

All of the constructions mentioned above relate to the implementation of the steps according to the invention in a gravure press. However, the described steps can, of course, also be carried out outside a printing machine.

What is claimed is:

1. A process of rotogravure printing of an image using an erasable and reusable gravure form including a blank form having a base screen designed for accommodating a maximum amount of ink to be transferred to a printing stock, while the form is mounted in a printing machine, the process comprising the steps of:

(a) applying a liquefying substance using an applicator to uniformly and completely fill depressions within the base screen so that a smooth surface results;

(b) screening the gravure form by removing varying amounts of the liquefiable substance from the depressions in conformity with an image intended to be printed using an image-printed transfer device;

(c) inking the screened gravure form using an inking system;

(d) printing in gravure on the printing stock; and (e) regenerating the blank form while in the printing machine and repeating step (a).

2. The process according to claim 1, wherein the step of filling the depressions is performed by utilizing hydrodynamic forces to apply the liquefiable substance in a liquid state.

3. The process according to claim 2, wherein the hydrodynamic force is capillary action.

4. The process according to claim 1, further comprising the steps of:

(f) applying an excess of liquefiable substance in a liquid state to the blank form; and (g) removing the excess liquefiable substance from the blank form after hardening using a doctor blade.

5. The process according to claim 1, wherein the liquefiable substance is applied in liquid form in conformance with a depth of the depressions in the base screen and further comprising the step of removing any excess liquefiable substance from the blank form using a doctor blade prior to hardening of the liquefiable substance.

6. The process according to claim 5, wherein step (a) includes the steps of:

(1) applying a liquefiable substance;

(g) drying the liquefiable substance; and (h) repeating steps (1) and (g) multiple times.

7. The process according to claim 1, wherein step (b) includes applying thermal energy to produce an image-forming ablation.

8. The process according to claim 1, further comprising the step of:

polishing a surface of the blank form after step (a).

9. The process as claimed in claim 1, wherein step (c) is performed by using a chamber doctor for inking the gravure form.

10. The process according to claim 1, wherein step (c) is performed by using highly pigmented inks for inking the screened gravure form.

11. The process according to claim 10, wherein the highly pigmented inks are water-based.

12. The process according to claim 1, wherein step (e) includes the steps of:

(f) cleaning ink residue from the gravure form; and (g) completely removing the liquefiable substance from the depressions in the base screen.

13. The process according to claim 12, further comprising the step of:

(h) repeating steps (n) and (o) each time steps (a) through (e) are performed.

14. The process according to claim 1, further comprising the steps of:

(f) repeating steps (a) through (d) a predetermined number of times;

(g) completely removing the liquefiable substance from the depressions in the base screen for each repetition of steps (a) through (d); and (h) filling only areas from which liquefiable substance was removed in step (b).

15. The process according to claim 1, wherein the liquefiable substance is a thermoplastic material.

16. The process according to claim 1, wherein the liquefiable substance is a photopolymer.

17. The process according to claim 1, wherein the liquefiable substance is a lacquer.

18. The process according to claim 1, wherein the liquefiable substance is one of a cross linkable polymer melt and polymer solution.

19. The process according to claim 1, wherein step (b) includes the steps of:

(f) cutting a foil including an absorbent material in conformance with the intended image to be produced for an image-forming ablation;

(g) ironing the foil over the filled blank form; and (h) sucking of the filling material out of the depressions in the base screen by the absorbent material.

20. The process according to claim 1, wherein step (b) includes the step of:

uniformly illuminating and imaging a micromirror array including tiltable micromirror elements on a surface of the gravure form to produce an image-forming ablation whereby addressing of the micromirror elements changes synchronously with rotation of a surface of the gravure form such that allocation of an image pixel to the surface of the gravure form is maintained along with a corresponding exposure data value along the entire imaging surface of the micromirror array on the surface of the gravure form.

21. The process according to claim 1, further comprising the step of:

(f) producing a gravure cell from a plurality of image pixels by addressing image pixels smaller than the gravure cell on a surface of the gravure form.

22. The process according to claim 21, further comprising the step of:

ablating the image pixels to form a number of steps having differing depths.

23. The process according to claim 22, wherein the number of steps ranges from 2 to 256.

24. The process according to claim 21, wherein image pixels smaller than surface elements of a base screen of the blank form are addressed by the image-forming ablation, said addressing of image pixels being performed independently from the base screen.

25. The process according to claim 21, wherein image pixels smaller than surface elements of a base screen of the blank form are addressed by the image forming ablation, said image pixels being arranged in a determined geometric ratio to the base screen.

26. The process according to claim 21, wherein the depressions of the base screen are structured as needed by the image-forming ablation.

27. A device for rotogravure printing of an image using an erasable and reusable gravure form cylinder rotating therein including a blank form including a base screen having depressions therein and being designed for accommodating maximum amount of ink to be transferred to printing stock, the apparatus comprising:

means for applying a liquefiable substance to uniformly and completely fill the depressions in the base screen so that a smooth outer surface results;

an image point transfer device for screening the gravure form cylinder by removing varying amounts of the substance from the depressions applied by said means for applying in conformance with the image being printed;

an inking system for inking the screened gravure form cylinder; and means for regenerating the base screen of the inked and screened gravure form cylinder for reusing the gravure form;

wherein the means for applying, the image point transfer device, the inking system and the means for regenerating each are spatially positioned about a circumference of the gravure form cylinder and adjustable proximally to the circumference of the gravure form so as to operate consecutively.

28. The device according to claim 27, wherein said blank form is a sleeve.

29. The device according to claim 27, further comprising:

first and second formed strips connected to the means for applying and positioned respectively on front and back sides of a gap between said blank form and means for applying and along said rotating direction of said gravure form cylinder, said second formed strip having a sharp edge conforming to a shape of said gravure form cylinder and being positioned at a small distance therefrom, and said first foriried strip being held towards said gravure form cylinder at a distance greater than said distance between said second formed strip and said gravure form cylinder.

30. The device as claimed in claim 29, wherein the distance between said second formed strip and the gravure form cylinder is less than one tenth of one millimeter.

31. The device as claimed in claim 30, wherein the distance between said first formed strip and said gravure form cylinder is between five hundredths of one millimeter and one half of one millimeter.

32. The device as claimed in claim 27, wherein said means for regenerating is an ultrasonic cleaning installation.

33. The device as claimed in claim 32, wherein said ultrasonic cleaning installation operates in one of a first mode using at least one of a liquid serving to loosen the ink and sonic energy of a level solely for removing substantially all remaining ink and a second mode for one of partial and complete removal of the filling material in the depressions of the base screen.

34. The device as claimed in claim 32, wherein said ultrasonic cleaning installation operates in one of a plurality of modes, a first mode using at least one of a liquid serving to loosen the ink and sonic energy of a level solely for removing substantially all remaining ink and each subsequent mode serving to remove an increasingly larger amount of the filling material in the depressions of the base screen.

35. The device as claimed in claim 32, wherein each of said subsequent modes of said plurality of modes has at least one of a correspondingly higher liquid pressure and liquid temperature than an immediately preceding mode.

36. The device as claimed in claim 27, wherein said regenerating device is a high-pressure water jet cleaning device.

37. The device as claimed in claim 27, wherein said high-pressure water jet cleaning device operates in one of a first mode using at least one of a liquid serving to loosen the ink and sonic energy of a level solely for removing substantially all remaining ink and a second mode for one of partial and complete removal of the filling material in the depressions of the base screen.

38. The device as claimed in claim 36, wherein said high pressure water jet cleaning device operates in one of a plurality of modes, a first mode using at least one of a liquid serving to loosen the ink and sonic energy of a level solely for removing substantially all remaining ink and each subsequent mode serving to remove an increasingly larger amount of the filling material in the depressions of the base screen.

39. The device as claimed in claim 36, wherein each of said subsequent modes of said plurality of modes has at least one of a correspondingly higher liquid pressure and liquid temperature than an immediately preceding mode.

40. The device as claimed in claim 27, wherein said image-point transfer device is a laser, said laser applying thermal energy to said surface of the gravure form.

41. The device as claimed in claim 27, wherein said laser is a high-energy laser.

42. The device as claimed in claim 40, wherein said laser is formed as a semiconductor laser arrangement having a plurality of semiconductor lasers.

43. The device as claimed in claim 27, wherein said image-point transfer device is an absorbent foil cut in conformity with the image to be printed and ironed on the base screen.

44. The device as claimed in claim 27, wherein said image-point transfer device is a micromirror array.

45. A process of rotogravure printing of an image using an erasable and reusable gravure form including a blank form having a base screen designed for accommodating a maximum amount of ink to be transferred to a printing stock, while the form is mounted in a printing machine, the process comprising the steps of:

(a) applying a liquefying substance by hydrodynamic force using an applicator to uniformly and completely fill depressions within the base screen so that a smooth surface results;

(b) screening the gravure form by removing varying amounts of the liquefiable substance from the depressions in conformity with an image intended to be printed using an image-printed transfer device;

(c) inking the screened gravure form using an inking system;

(d) printing in gravure on the printing stock; and (e) regenerating the blank form using an ultrasonic cleaning installation while in the printing machine and repeating step (a).

46. A device for rotogravure printing of an image using an erasable and reusable gravure form cylinder rotating therein including a blank form including a base screen having depressions therein and being designed for accommodating maximum amount of ink to be transferred to printing stock, the apparatus comprising:

means for applying a liquefiable substance to uniformly and completely fill the depressions in the base screen so that a smooth outer surface results;

an image point transfer device for screening the gravure form cylinder by removing varying amounts of the substance from the depressions applied by said means for applying in conformance with the image being printed;

an inking system for inking the screened gravure form cylinder; and an ultrasonic cleaning installation;

means for regenerating the base screen of the inked and screened gravure form cylinder for reusing the gravure form, the means for regenerating the base screen including the ultrasonic cleaning installation;

wherein the means for applying, the image point transfer device, the inking system and the means for regenerating each are spatially positioned about a circumference of the gravure form cylinder and adjustable proximally to the circumference of the gravure form so as to operate consecutively.

* * * * *